US009539629B2

(12) United States Patent
Seidel et al.

(10) Patent No.: US 9,539,629 B2
(45) Date of Patent: Jan. 10, 2017

(54) METHOD AND DEVICE FOR COOLING A LEADER OR BAND OF A METAL STRAND IN A HOT-ROLLING MILL

(75) Inventors: Jürgen Seidel, Kreuztal (DE); Uwe Baumgärtel, Hilchenbach (DE); Andreas Wied, Bad Laasphe (DE)

(73) Assignee: SMS GROUP GMBH, Düsseldorf (DE)

( * ) Notice: Subject to any disclaimer, the term of this patent is extended or adjusted under 35 U.S.C. 154(b) by 779 days.

(21) Appl. No.: 13/121,773

(22) PCT Filed: Sep. 21, 2009

(86) PCT No.: PCT/EP2009/006802

§ 371 (c)(1),
(2), (4) Date: May 10, 2011

(87) PCT Pub. No.: WO2010/037481

PCT Pub. Date: Apr. 8, 2010

(65) Prior Publication Data

US 2011/0209515 A1 Sep. 1, 2011

(30) Foreign Application Priority Data

Sep. 30, 2008 (DE) ..... 10 2008 049 537

(51) Int. Cl.
*B21B 45/02* (2006.01)
*B21B 37/44* (2006.01)
(Continued)

(52) U.S. Cl.
CPC ..... *B21B 45/0218* (2013.01); *B21B 37/44* (2013.01); *B21B 15/005* (2013.01); *B21B 39/084* (2013.01); *B21B 2027/103* (2013.01)

(58) Field of Classification Search
CPC .. B21B 45/0218; B21B 45/0233; B21B 37/44; B21B 37/74; B21B 15/005; B21B 2027/103; B21B 45/02; B21B 45/0203; B21B 45/0209; C21D 9/5735; C21D 1/667; C21D 9/573; C21D 11/005
(Continued)

(56) References Cited

U.S. PATENT DOCUMENTS 4,440,584 A * 4/1984 Takeshige et al. ..... 72/201
5,235,840 A * 8/1993 Blazevic ..... 72/201
(Continued)

FOREIGN PATENT DOCUMENTS

DE 3230866 7/1985
DE 3523483 1/1987
(Continued)

OTHER PUBLICATIONS

English abstract of JP59-78710 from JPO, ITO Yasumichi, 1984, JPO.*

*Primary Examiner* — David Bryant
*Assistant Examiner* — Mohammad Yusuf
(74) *Attorney, Agent, or Firm* — Lucas & Mercanti, LLP; Klaus P. Stoffel

(57) ABSTRACT

A method and device for cooling a preliminary strip of metal in a hot rolling mill including work rolls by spraying a cooling agent on to the preliminary strip, screening the preliminary strip in an edge area of the strip from influence of the cooling agent, and deflecting the cooling agent in the area of the strip edges of the preliminary strip, wherein the cooling agent is deflected from the strip edges in an area of an inlet guide of a work a work roll.

10 Claims, 3 Drawing Sheets

(51) Int. Cl.

| | |
|---|---|
| *B21B 15/00* | (2006.01) |
| *B21B 39/08* | (2006.01) |
| *B21B 27/10* | (2006.01) |

(58) Field of Classification Search
USPC ..... 72/202, 185, 236, 201
See application file for complete search history.

(56) References Cited

U.S. PATENT DOCUMENTS

| | | | | |
|---|---|---|---|---|
| 6,164,110 | A * | 12/2000 | Seidel | 72/201 |
| 6,301,906 | B1 * | 10/2001 | Thiel et al. | 72/201 |
| 6,368,428 | B1 * | 4/2002 | Thiel et al. | 72/201 |
| 7,159,433 | B2 * | 1/2007 | Seidel | 72/201 |

FOREIGN PATENT DOCUMENTS

| | | |
|---|---|---|
| DE | 4134599 | 2/1993 |
| EP | 1399277 | 8/2005 |
| EP | 1634657 | 3/2006 |
| GB | 2177332 | 1/1987 |
| JP | S5371661 | 6/1978 |
| JP | 59078710 | 5/1984 |
| JP | S6261713 | 3/1987 |
| JP | H0570712 | 5/2007 |
| WO | 2007055503 | 5/2007 |

* cited by examiner

METHOD AND DEVICE FOR COOLING A LEADER OR BAND OF A METAL STRAND IN A HOT-ROLLING MILL

The present application is a 371 of International application PCT/EP2009/006802 filed Sep. 21, 2009, which claims priority of DE 10 2008 049 537.9, filed Sep. 30, 2008, the priority of these applications is hereby claimed and these applications are incorporated herein by reference.

BACKGROUND OF THE INVENTION

The invention relates to a method and a device for cooling a preliminary strip or strip of a metal strand in a hot rolling mill which contains work rolls, wherein a cooling agent is sprayed onto the preliminary strip or the strip.

In a hot rolling mill, several cooling devices are known or defined in the areas of the preliminary train and the finishing train, such as:

- the preliminary strip cooling (arrangement between preliminary stand and first finishing stand)
- the intermediate stand cooling (arranged between two finishing stands)
- the strip bottom side cooling (positioned in front of a lateral guidance or behind a loop lifter)
- roll gap cooling (cooling of the strip shortly before the roll gap on both sides or one side).

The various cooling devices influence the surface temperature pattern, scale growth, mechanical properties, production quantity, etc. The cooling occurs uniformly across the width of the strip. As a rule, the temperature of the preliminary strip as well as the strip temperature are colder in the entire finishing train in the areas of the strip edges. The above-mentioned cooling devices further enforce this effect. By using the method and devices described in the invention, this disadvantage is to be avoided and the temperature uniformity is to be even improved. The novel cooling method or cooling device will be described in more detail in connection with the example of the roll gap cooling.

A device of this type is known from patent DE 4134599 C1. This patent relates to a method for hot rolling of metal strip with one or more passes, wherein especially on the inlet side of the roll stand or the roll stands the preliminary strip or the strip are cooled.

The known method is characterized in that the spraying of the cooling liquid on the inlet side over the entire width of the metal strip takes place as closely as possible in front of the roll gap onto the metal strip and onto the jackets of the work rolls, so that the strip surface is undercooled and thereby a low thermal flux into the work roll is created.

This manner of operation is based on the recognition that by cooling the strip surface of a steel strip immediately prior to entering the roll gap formed by two rolls the service life of the roll surface is increased to a significant extent. As a result of this measure a "peeling" of the work rolls, i.e., a separation of the oxide layer from the upper surface of the work roll, is substantially avoided or significantly postponed. This also has an indirect positive effect on the quality of the strip surface.

As a rule, the temperature of the preliminary strip as well as of the strip of a metal strip to be rolled is lower in the middle of the preliminary strip or of the strip. In FIG. 1, the temperature of a metal strip is illustrated as a function of the width of the metal strip which travels through the roll stands of a hot rolling mill. In this drawing, the strip middle of a metal strip is illustrated at the left border of the diagram. A curve 1 shows the pattern of the temperature prior to the entry of the metal strip into a roll stand. A curve 2 shows the temperature pattern after the emergence from the roll stand. In both curves, the sharp temperature drop in the edge areas of the metal strip can be recognized. Due to the fact that the temperature of the metal strip, as well as of the preliminary metal strip, is lower in the edge areas than in the middle, different local loads act on the metal strip which themselves have a negative effect on the metal strip as well as on the work rolls. The affected areas of the work rolls may wear to a greater extent, so that profile anomalies and/or problems with respect to strip planeness occur. The cold strip edges can also have a negative effect on the metallurgical properties at the edges of the strip.

The use of a method known from the prior art for cooling the middle of the strip prior to the roll gap can even further increase the temperature difference of the strip toward the strip edges and the associated negative effects. Similar effects also occur in the other cooling devices mentioned above.

U.S. Pat. No. 5,235,840 discloses a device for processing a steel strip in the hot rolling plant and a method for minimizing scale growth on the steel strip, as well as for reducing the wear of the work rolls in the finishing train. In order to reduce the scale growth or oxidation of the steel strip, the steel strip is sprayed within the finishing rolling train at selected locations on the strip with cooling agent, wherein the surface temperature of the strip is controlled or regulated in such a way that it is within a temperature range within which the scale growth or the oxidation is minimized. This automatically minimizes the wear of the work rolls.

European Patent Application EP 1 634 657 A1 discloses a system for controlling or regulating the cooling agent application on a steel plate after the plate has been hot and cold rolled. For this purpose, the temperature distribution on the steel strip and steel plate is simplified in the width direction prior to the beginning of the cooling process and the steel plate is then cooled by means of a cooling regulation with a cooling rate which is equal over the width.

German Patent DE 32 30 866 discloses a device for cooling a steel sheet plate immediately after hot rolling. In the area of the side edges of the steel sheet plate, screening members are arranged which can be moved in the width direction of the steel sheet plate which is placed on a roller conveyor toward each other and away from each other by means of a displacement device.

Japanese Patent Application JP 59078710 discloses a method for controlling or regulating the temperature of a finished-rolled steel strip, wherein screening devices are provided at opposite located edges of the steel strip, wherein the screening devices prevent the impingement of cooling agent on the edges of the steel strip. The screening devices can be moved toward each other and away from each other and can in this manner be adjusted to the width of the steel strip. In addition, the area of the middle of the steel strip can be defined which is to be sprayed with the cooling agent.

SUMMARY OF THE INVENTION

Starting from this prior art, the invention is based on the object of making available an alternative method and a rolling mill with an alternative cooling device for applying a cooling agent on the preliminary strip or the strip.

The active roll gap cooling according to the present invention results in a homogenous uniform temperature pattern over the transverse profile according to curve 3 in FIG. 1 and further improves the strip properties and the wear of the rolls.

Preferably, a method is used according to which the cooling agent is deflected in the areas of the strip edges of the preliminary strip or of the strip, so that it does not impinge on the preliminary strip or the strip in the areas of the strip edges. Preferably, the cooling agent is deflected in the areas of the strip edges toward areas outside of the preliminary strip or the strip, although, in principle, it would also be possible to deflect the cooling agent toward the strip middle. Preferably, the measures according to the present invention are carried out in the areas of the inlet guidance of the work rolls.

The above mentioned of the invention is additionally met by the hot rolling mill according to the present invention.

The lateral guides are arranged in particular in front of an inlet gap formed each by two work rolls. In this connection, the means for screening the strip edges are fastened to the lateral guides, particularly as separate structural elements. They can advantageously be moved together with the lateral guides transversely of the train travel direction of the preliminary strip or the strip. The screening means further advantageously ensure that the cooling agent is deflected by the preliminary strip or the strip away toward the outside.

The screening means can also be arranged in the area following a loop lifter or looper on the bottom side of the preliminary strip or the strip.

In the following, the invention will be explained in more detail in connection with embodiments.

DETAILED DESCRIPTION OF THE INVENTION

Figure 1:
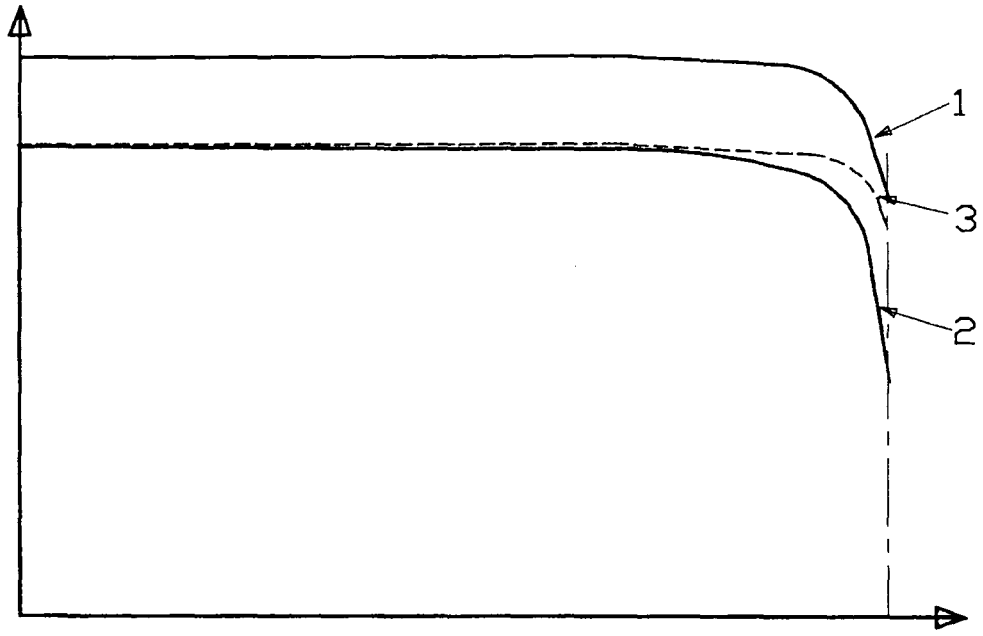
FIG. 1 is a graph plotting temperature of a metal strip as a function of strip width.
Figure 2A:
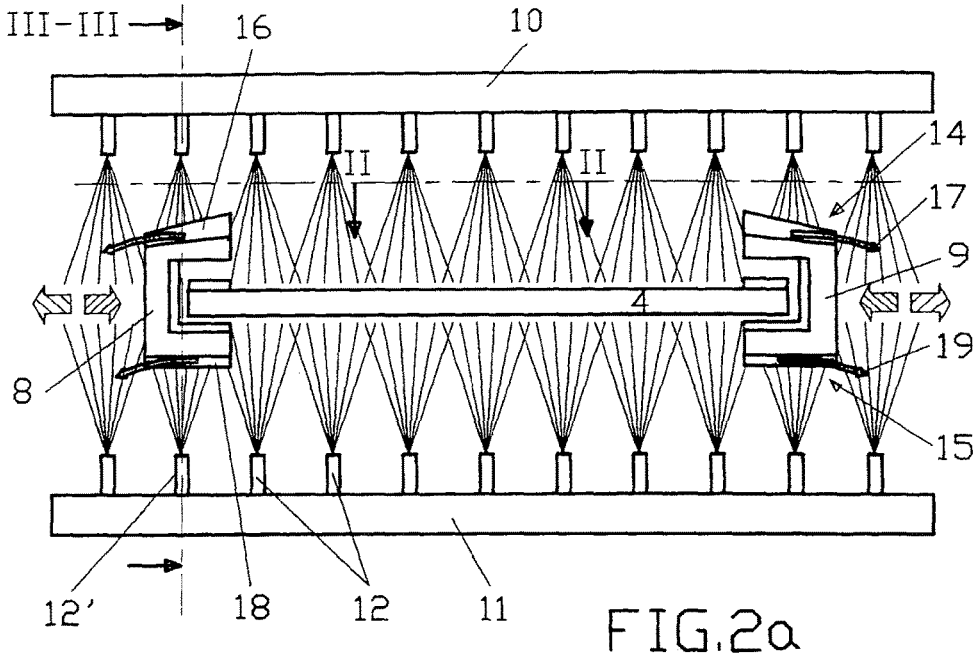
FIG. 2*a* shows a sectional view of a metal strip traveling through a roll stand in the area between two cooling beams transversely of the travel direction with lateral guides and devices in the side areas of the metal strip for screening the cooling agent from the edge areas of the metal strip in front of the inlet gap of two work rolls.

In a rolling mill including a plurality of roll stands, a preliminary strip and a strip 4 (FIGS. 2*a*, 3) of a metal strand to be rolled run through the roll gaps 5 between always two work rolls 6, 7. In the areas in front of the work rolls 6, 7 lateral guides 8, 9 are mounted at the side edges of the strip 4, wherein the guides 8, 9 are constructed approximately U-shaped in cross section and engage over the strip 4 on the top side and the bottom side in the edge areas thereof.

On the upper and lower sides of the strip 4, cooling devices are provided as cooling beams 10, 11 from whose nozzles 12 is sprayed a cooling agent, particularly water, under pressure onto the surface of the strip 4 in order to cool the strip. The nozzles 12 produce on the surface of the strip 4 impingement areas 13 of the cooling agent. According to the invention, screening devices 14, 15 are provided which prevent the cooling medium from being sprayed directly onto edge regions of the strip 4 from the nozzles 12' in the edge areas of the strip 4. The screening devices 14, 15 deflect the cooling agent jet always preferably in the area laterally of the strip 4.

In particular the upper screening device 14 therefore includes on both sides of the strip 4 downwardly inclined plates 16 and 17, inclined toward the outer side of the strip 4. On the bottom side of the strip 4, plates 18, 19 of the screening device 15 can also extend horizontally relative to the plane formed by the strip 4 because the cooling agent is already deflected downwardly as a result of the force of gravity.

Preferably, the screening devices 14, 15 or 16, 18 can be attached to the guides 8, 9 as separate components, or the screening devices 14, 15 or 16, 18 are fixed components of the guides 8, 9. If the guides 8, 9 are displaceable in accordance with the width of the strip 4 to be rolled transversely of the travel direction of the strip 4 in the direction of double arrows A, B, the screening devices 14, 15 or 16, 18 are displaced in the same manner. It can also be provided that the plates 18, 19 are pivotable or inclined in order to adjust the impingement area of the screened cooling agent jets.

Figure 2B:
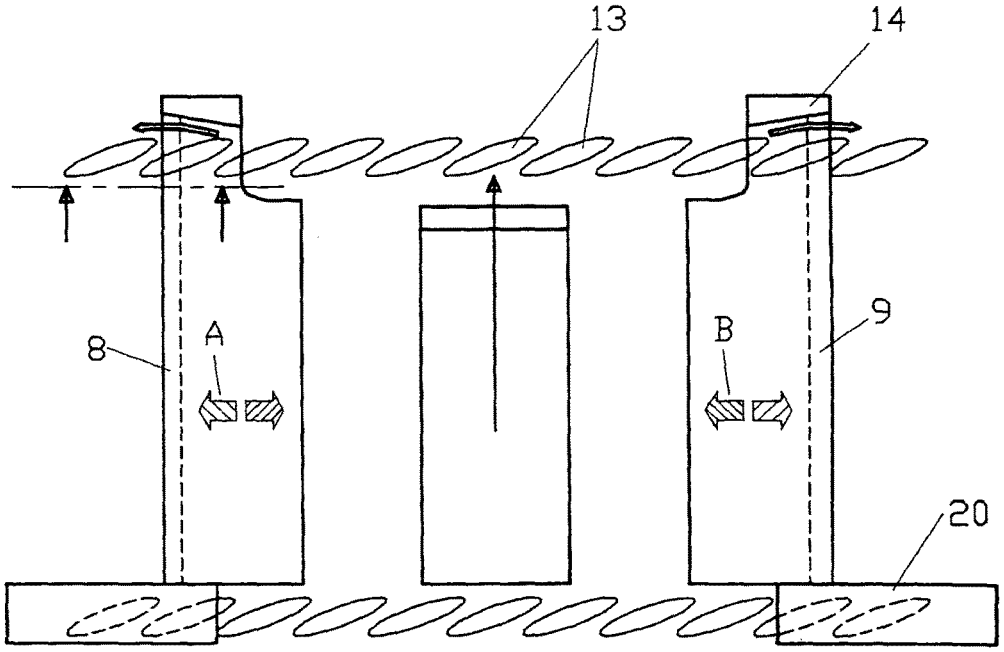
FIG. 2*b* is a top view of the metal strip according to a line II-II of FIG. 2*a* and additionally a screening device for screening cooling agent which is arranged in front of the inlet lateral guides.
Figure 3:
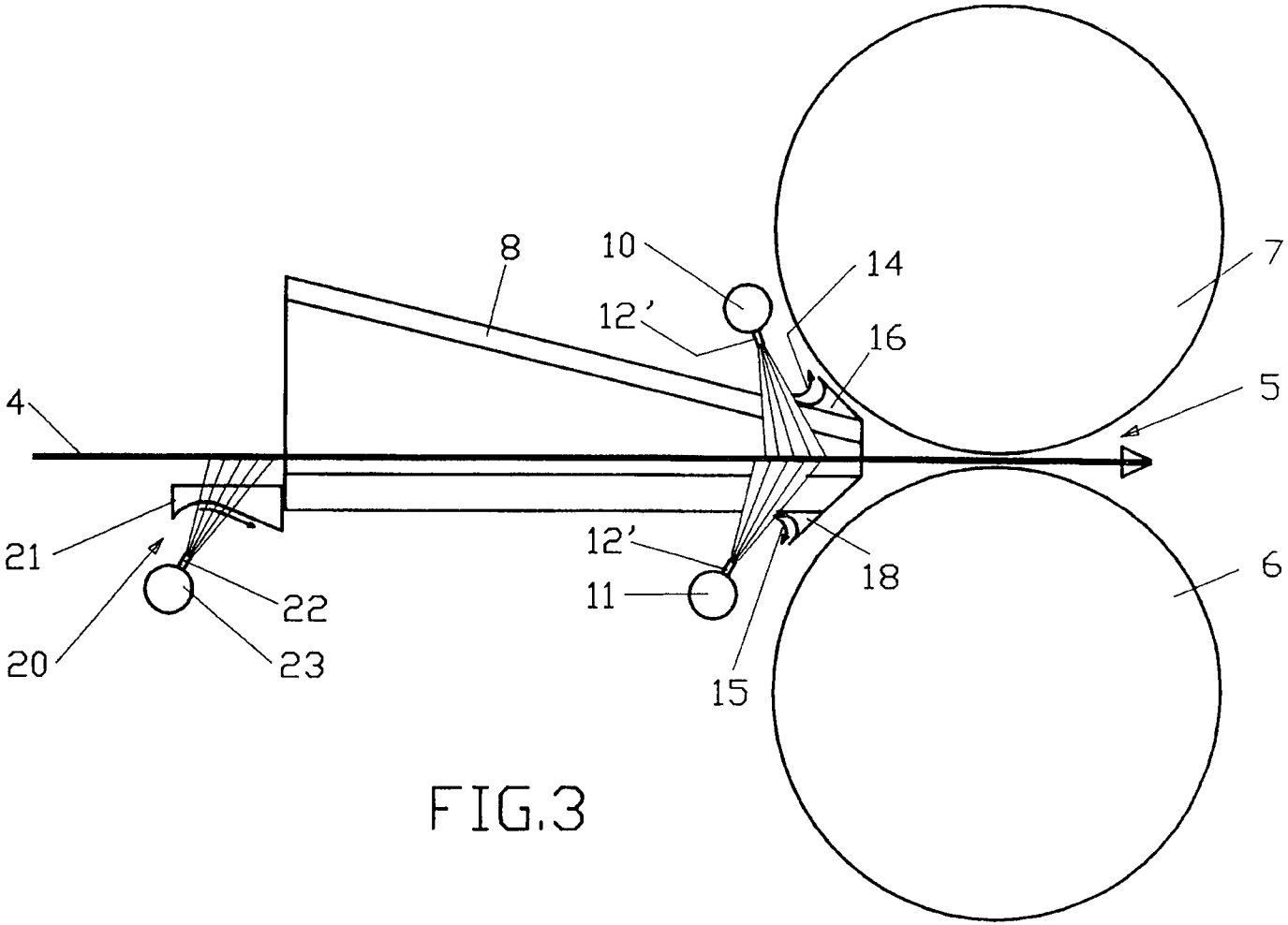
FIG. 3 shows a sectional view of the metal strip and a lateral guide in accordance with line III-III of FIG. 2*a*, as well as additionally the cross sectional view of the screening device arranged in front of the lateral guide.

In addition to the arrangement of the screening devices 14, 15 or 16, 18 in the areas in front of the roll gaps 5 between work rolls 6, 7, a screening device 20 can also be arranged in front of the lateral guides 8, 9 on the bottom side of the strip 4; this is additionally illustrated in FIGS. 2*b*, 3. The screening device 20 is in principle constructed as the screening devices 14, 15 or 16, 18 and comprises in the same manner the plates 21 for deflecting the cooling agent which flows from the nozzles 22 of a cooling beam 23.

It is understood that the invention can be used independently of the fact whether the cooling agent flows from individual nozzles or is injected in form of a curtain on the strip 4 which has a rectangular nozzle opening extending over the width of the strip 4. In addition to water it is also possible to use as cooling agent other media, such as liquid nitrogen or water/air mixtures.

The device for screening the edges of the strip 4 described in connection with the Figures can also be utilized within the finishing train at various locations, particularly also in a preliminary strip cooling or an intermediate stand cooling. In this connection, separate adjusting mechanisms can be used for moving and adjusting the screening elements to the strip width.

The invention claimed is:

1. A method for cooling a preliminary strip or strip of a metal strand in a hot rolling mill including work rolls, comprising the steps of: spraying a cooling agent onto the preliminary strip or strip as the strip moves in a travel direction; screening the preliminary strip or strip in an area of edges of the strip from influence by the cooling agent; guiding the strip with lateral guides; and, simultaneously deflecting the cooling agent in the area of the strip edges of the preliminary strip or the strip with downwardly inclined plates mounted only on a downstream end, relative to the travel direction, of the lateral guides so that the cooling agent is deflected from the strip edges immediately in front of a roll gap between the work rolls in an area of the lateral guide, wherein the inclined plates and the lateral guides are moved together transversely to a travel direction of the strip to adjust positioning of the inclined plates and the lateral guides.

2. The method according to claim 1, including deflecting the cooling agent in the area of the strip edges to areas outside of the preliminary strip or the strip.

3. A hot rolling mill, comprising: a preliminary train and a finishing train for rolling a preliminary strip or a strip of a metal strand with work rolls; lateral guides for guiding the preliminary strip or strip, the lateral guides being arranged in front of an inlet gap formed by two work rolls; a cooling device for applying a cooling agent to the preliminary strip or the strip as the strip moves in a travel direction; and means for screening the strip edges of the preliminary strip or strip from the influence of the cooling agent immediately in front of a roll gap between the work rolls, wherein the screening means includes downwardly inclined plates mounted only on a downstream end, relative to the travel direction, of the lateral guides, wherein the screening means are moveable together with the lateral guides transversely of a travel direction of the preliminary strip or the strip.

4. The rolling mill according to claim 3, wherein the screening means are separate structural elements.

5. The rolling mill according to claim 3, wherein the means deflect the cooling agent outwardly away from the preliminary strip or the strip.

6. The rolling mill according to claim 3, and further comprising a loop lifter, wherein the screening means are arranged on a bottom side of the preliminary strip or the strip in an area following a loop lifter.

7. The rolling mill according to claim 3, further comprising further means for screening the strip edges in an area of an intermediate stand cooling.

8. The rolling mill according to claim 7, wherein the further means for screening the strip edges is arranged in a cooling device in areas between a preliminary stand and a first finishing stand.

9. The rolling mill according to claim 7, wherein the further screening means includes a screening width adjustment device.

10. The rolling mill according to claim 9, wherein the screening width is adjustable differently for various devices.

* * * * *